US005477915A

United States Patent [19]

Park

[11] Patent Number: 5,477,915

[45] Date of Patent: Dec. 26, 1995

[54] REFRIGERATOR CAPABLE OF CHANGING FUNCTIONS FOR COMPARTMENTS AND A CONTROL METHOD THEREFOR, IN PARTICULAR FOR FERMENTATION OF KIMCHI

[75] Inventor: Youn T. Park, Suwon, Rep. of Korea

[73] Assignee: Samsung Electronics Co., Ltd., Suwon, Rep. of Korea

[21] Appl. No.: 177,993

[22] Filed: Jan. 6, 1994

[30] Foreign Application Priority Data

Feb. 25, 1993 [KR] Rep. of Korea ..... 93-2701

[51] Int. Cl.[6] ..... F25B 29/00; A23B 4/00

[52] U.S. Cl. ..... 165/30; 165/918; 99/468/470; 99/483; 99/486; 62/198; 62/199

[58] Field of Search ..... 62/199, 198, 200, 62/504, 525; 165/30, 918; 99/468, 470, 483, 486

[56] References Cited

U.S. PATENT DOCUMENTS

| | | | |
|---|---|---|---|
| 2,102,015 | 12/1937 | Maccabee | 62/200 |
| 2,586,454 | 2/1952 | Brandin | 62/198 |
| 4,439,998 | 4/1984 | Horvay et al. | 62/199 |
| 5,228,499 | 7/1993 | Yoon . | |
| 5,351,745 | 10/1994 | Park | 62/198 |

FOREIGN PATENT DOCUMENTS

| | | | |
|---|---|---|---|
| 0723128 | 6/1942 | Germany | 62/198 |
| 3105414 | 11/1982 | Germany | 62/198 |
| 0183312 | 10/1983 | Japan | 62/200 |
| 2144838 | 3/1985 | United Kingdom | 62/198 |

*Primary Examiner*—John K. Ford
*Attorney, Agent, or Firm*—Burns, Doane, Swecker & Mathis

[57] ABSTRACT

A refrigerator includes a first and second compartments which are cooled by first and second heat exchangers, respectively, of a cooling system. The first heat exchanger includes upstream and downstream heat exchanger sections. A first valve is arranged for conducting refrigerant from the upstream heat exchanger section either to the downstream heat exchanger section or to a second valve disposed upstream of the second heat exchange. The second valve can conduct the refrigerant either to the second heat exchange or to a compressor of the cooling system. By a selected actuation of the first valve, the first compartment can be used as a freezing compartment or a refrigeration compartment. By a selected actuation of the second valve, the second compartment can be used as a refrigeration compartment, or not cooled at all. If the second compartment is not cooled, it can be heated for use as a food fermentation compartment.

3 Claims, 12 Drawing Sheets

REFRIGERATOR CAPABLE OF CHANGING FUNCTIONS FOR COMPARTMENTS AND A CONTROL METHOD THEREFOR, IN PARTICULAR FOR FERMENTATION OF KIMCHI

BACKGROUND OF THE INVENTION

1. Field of the Invention

The present invention is related to a refrigerator, which is capable of changing functions of its compartments at user's wish, and a control method therefor.

2. Description of the Prior Art

A conventional refrigeration cycle consists of a series of refrigerant phase changing means which are embodied by a compressor, a condenser, an expansion valve (or a capillary tube) and an evaporator, and a refrigerant tube for connecting the phase changing means in series with each other.

On the other hand, a so-called direct cooling type refrigerator generally has two evaporators arranged in its freezing and refrigerating compartments, respectively, and a three-way valve whose inlet and one of the two outlets are inter-connected with respective ones of the evaporators. In the direct cooling type refrigerator, the flow of the refrigerant into each evaporator is controlled by the three-way valve. More specifically, the inlet of the three-way valve is connected to the outlet of the evaporator for the freezing compartment, and one outlet of the three-way valve is connected to the inlet of the evaporator for the refrigerating compartment. The other outlet of the three-way valve is directly connected through a bypass tube to the inlet of a compressor. In the configuration, the refrigerant which passes through the evaporator for the freezing compartment either flows to the evaporator for the refrigerating compartment or is directed to the compressor according to the position of a spool, in the three-way valve, thereby maintaining the desired temperatures in the freezing and refrigerating compartments.

However, there is an inconvenience in the conventional direct cooling type refrigerator in that the user can not optionally alter the functions for the compartments according to the amount of food to be stored because the functions for the compartments are fixed to the freezing and refrigerating compartments.

Recently, there has been developed a refrigerator having a compartment which can either ferment or refrigerate a fermentation food such as Kimchi therein. Kimchi is a Korean traditional food which is made of radish, cabbage or cucumber, and spiced with pepper, garlic, onion, ginger, etc. An example of this type of refrigerator is disclosed in commonly owned U.S Pat. No. 5,228, 499. However, the U.S Patent is related to a so-called indirect cooling type refrigerator. The indirect cooling type refrigerator controls the amount of cool air which is generated from a single evaporator and then supplied to each compartment by the opening or closing of dampers arranged in the compartments.

However, a direct cooling type refrigerator having a compartment in which the food can be either fermented or refrigerated has not been developed. It is well known that the direct cooling type refrigerator has an advantage in that the temperature of any given compartment can be quickly raised to a desired temperature. Because the technique for fermenting Kimchi is disclosed in U.S Pat. No. 5,142,969, a more detailed description therefor will be omitted from this specification.

SUMMARY OF THE INVENTION

It is an object of the present invention to provide a direct cooling type refrigerator, which is capable of changing functions of its compartments at user' wish, and a control method therefor.

It is another object of the present invention to provide a refrigerator capable of fermenting and/or refrigerating a food item, and a control method therefor.

In order to achieve these objects, the refrigerator according to the present invention comprises first and second compartments for storing food; a compressor, a condenser and an expansion valve for forming a refrigeration cycle; first and second cooling means for lowering the temperature of the first and second compartment respectively; the cooling means forming an element of the refrigeration cycle; and, first and second control means for controlling the flow of the refrigerant in relation to each respective cooling means to change the functions of each compartment.

In the configuration, each control means may be preferably embodied by an electromagnetically operated three-way valve. The first compartment may function as either a freezing compartment or a refrigerating compartment by controlling the first three-way valve. The second compartment may function as a refrigerating compartment or not have any functions by controlling the second three-way valve. Furthermore, if a heating means is provided in the second compartment, it is possible for the second compartment to function as a food fermenting compartment.

On the other hand, the control method in a refrigerator including the first and second compartments for storing food; a compressor, a condenser and an expansion valve for forming a refrigeration cycle; first and second cooling means for lowering the temperature of the first and second compartments respectively, the cooling means forming an element of the refrigeration cycle; and, first and second control means for controlling the flow of the refrigerant in relation to each cooling means to change the functions of each compartment, comprises the steps of inputting the functions for each compartment and controlling the operation of the compressor and the first and second control means.

In the method, each control means may be preferably embodied by an electromagnetically operated three-way valve. The first compartment may function as either a freezing compartment or a refrigerating compartment by controlling the first three-way valve. The second compartment may function as a refrigerating compartment or not have any functions by controlling the second three-way valve. Furthermore, if a heating means is provided in the second compartment, it is possible for the second compartment to function as a food fermenting compartment.

BRIEF DESCRIPTION OF THE DRAWINGS

These and other aspects of the present invention are clarified in the accompanying drawings in which.

DETAILED DESCRIPTION OF THE PREFERRED EMBODIMENT

Hereinafter, a preferred embodiment according to the present invention will be described in detail with reference to the accompanying drawings.

Figure 1:
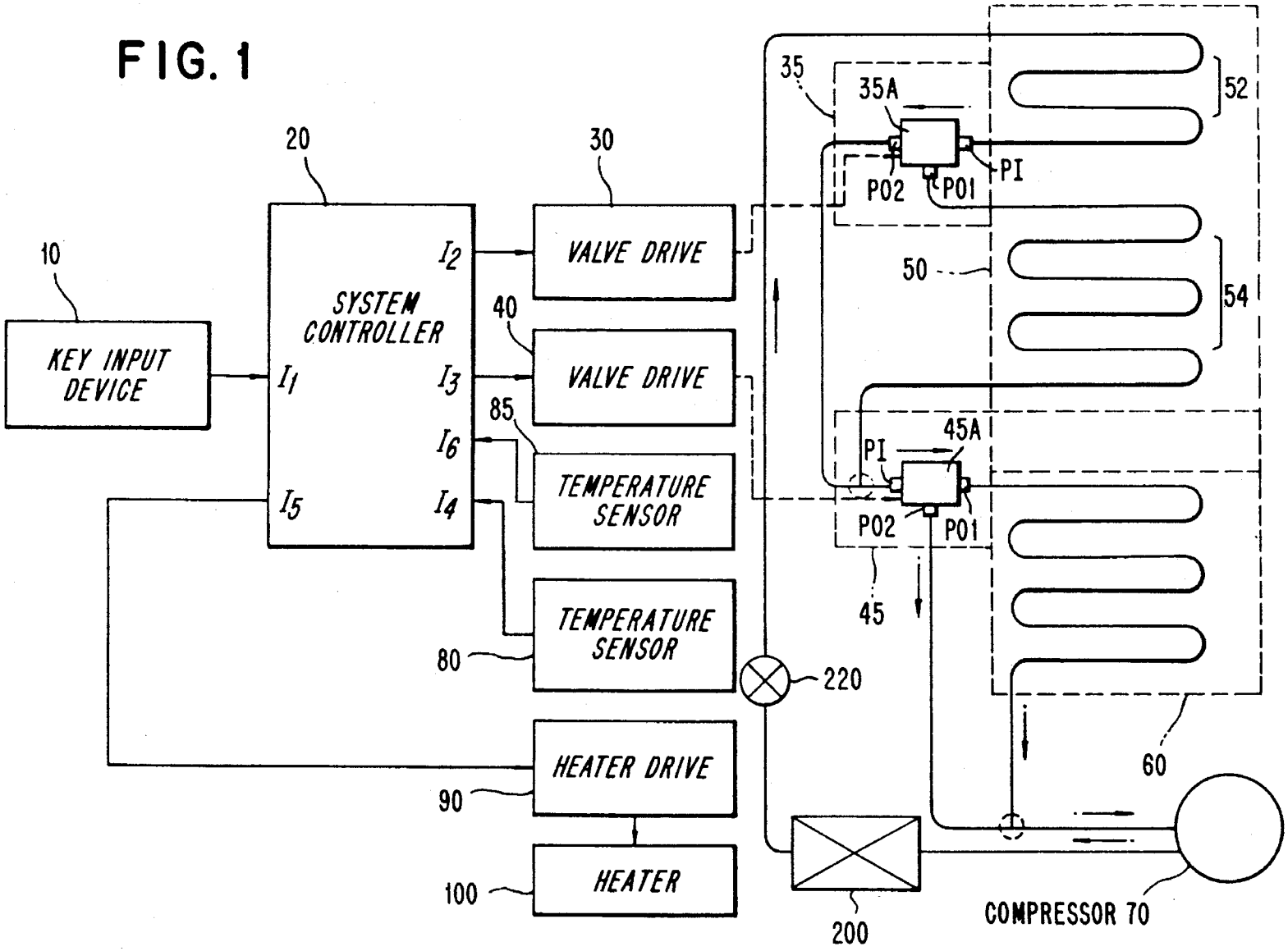
FIG. 1 is a block diagram of a control apparatus for a refrigerator according to the present invention.
Figure 2:
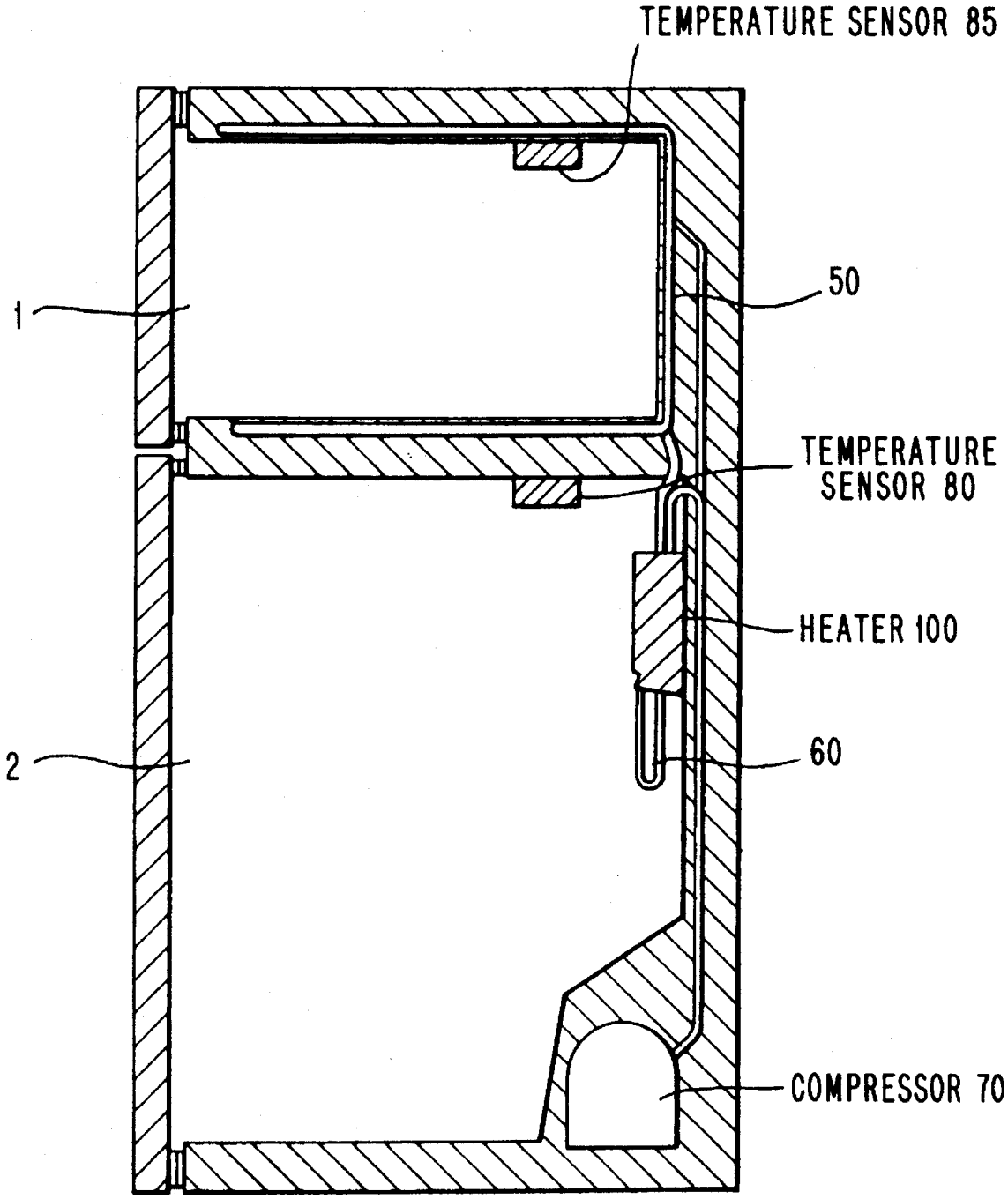
FIG. 2 is a cross-sectional view of a refrigerator according to the present invention; and, FIGS. 3 to 9 are flow charts explaining various control methods for a refrigerator according to the present invention.

Referring to FIGS. 1 and 2, the refrigerator has at least two compartments 1 and 2 for storing food. A system controller 20, which is preferably embodied by a microprocessor 10, is connected to peripheral equipment to control the entire operations of the refrigerator based on the data from a key input device 10. A first refrigerant flow controller 35 may be preferably embodied by an electromagnetically operated three-way valve 35A, in which inlet PI and first outlet PO1 are arranged in the middle of a first heat exchanger in the form of a first evaporator 50 provided in the first compartment 1. The first evaporator 50 is divided into upstream and downstream sections 52, 54 interconnected by the first three-way valve 35A. A second refrigerant flow controller 45 may be preferably embodied by an electromagnetically operated three-way valve 45A. The inlet PI of the second three-way valve 45A is connected to the outlet of the second section 54 of the first evaporator 50, and the first outlet PO1 of the second three-way valve 45A is connected to the inlet of a second heat exchanger in the form of a second evaporator 60 provided in the second compartment 2. The second outlet P02 of the first three-way valve 35A is also connected to the inlet PI of the second three-way valve 45A via a bypass tube. The second outlet P02 of the second three-way valve 45A is directly connected to the inlet of a compressor 70 via a bypass tube, and the outlet of the second evaporator 60 is also connected to the inlet of the compressor 70. The outlet of the compressor 70 is connected to the inlet of the first evaporator 50 via a condenser 200 and an expansion valve 220 (or a capillary tube), not shown, which form a conventional refrigeration cycle.

The spools, not shown, in the first and second three-way valves 35A and 45A are electromagnetically shifted by drive signals from valve drive portions 30 and 40 which are turned "ON" or "OFF" according to the control signal from the system controller 20.

A temperature sensor 80 is arranged in a suitable position of the second compartment 2 to provide the temperature value of the second compartment 2 to the input port I4 of the system controller 20. The reference number 85 denotes a temperature sensor for sensing the temperature of the first compartment 1.

A heater 100 for raising the temperature of the second compartment 2 in the fermentation mode is provided in the second compartment 2. A heater drive portion 90 is turned "ON" or "OFF" according to the control signal of the system controller 20, thereby connecting or disconnecting the power source line to the heater 100.

A blower fan, not shown, may be preferably provided in the second compartment 2 to evenly diffuse the heat generated from the heater 100 throughout the second compartment 2.

The first outlets PO1 of the first and second three-way valves 35A and 45A are respectively opened when the second outlets PO2 thereof are closed. Conversely, the first outlets PO1 of the first and second three-way valves 35A and 45A are closed when the second outlets PO2 thereof are opened.

In the afore-mentioned refrigerator, when the outlet PO1 of the first three-way valve 35A is opened, the refrigerant which passes through the first section 52 of the first evaporator 50 flows into the second section 54 of the first evaporator 50, thereby relatively increasing the refrigerating rate per unit time. Consequently, the first compartment 1 may function as a freezing compartment.

Conversely, when the first outlet PO1 of the first three-way valve 35A is closed, the refrigerant which passes through the first section 52 of the first evaporator 50 directly flows into the compressor 70 while bypassing the second section 54 of the first evaporator 50, thereby relatively lowering the refrigerating rate per unit time. Consequently, the first compartment 1 functions as a refrigerating compartment.

When the outlet PO1 of the second three-way valve 45A is opened, the refrigerant which passes through the first evaporator 50 flows into the second evaporator 60. Accordingly, the second compartment 2 functions as a refrigerating compartment.

On the other hand, when the outlet PO1 of the second three-way valve 45A is closed, the refrigerant which passes through the first evaporator 50 directly flows into the compressor 70 with bypassing the second evaporator 60. Accordingly, the second compartment 2 is not used for refrigerating food.

When the second compartment 2 functions as a fermenting compartment, the temperature of the second compartment 2 may be maintained at a given temperature, which is appropriate to ferment food, by alternatively operating the second three-way valve 45A and the heater 100.

As explained above, the user may select the first compartment 1 to act as either a freezing or a refrigerating compartment, and the second compartment 2 to act as either a refrigerating or a fermenting compartment. Furthermore, the user may select to stop using the second compartment 2.

Hereinafter, the control method for a refrigerator according to the present invention will be described in detail with reference to FIGS. 3 to 9.

Figure 3A:
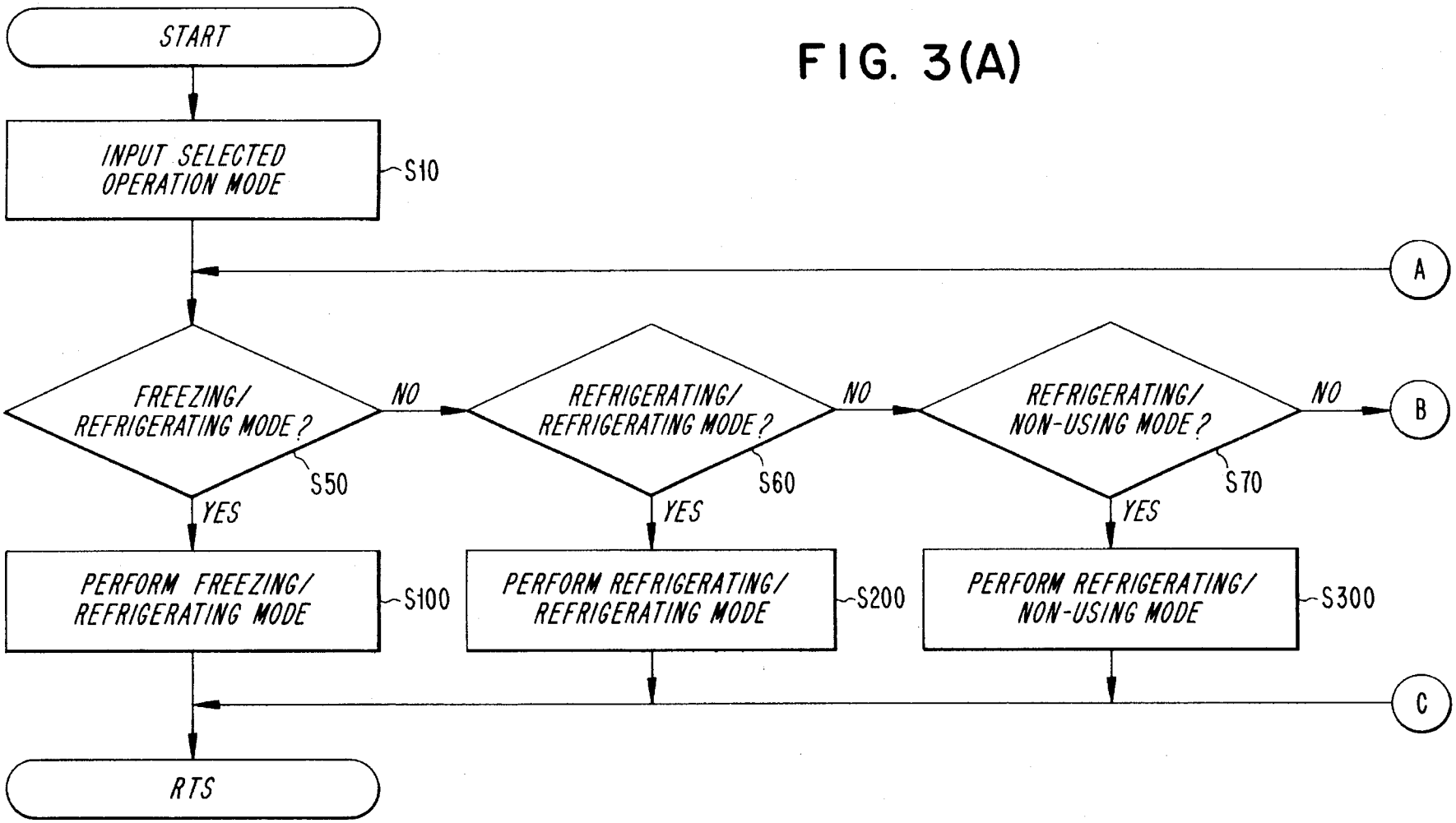
Figure 3B:
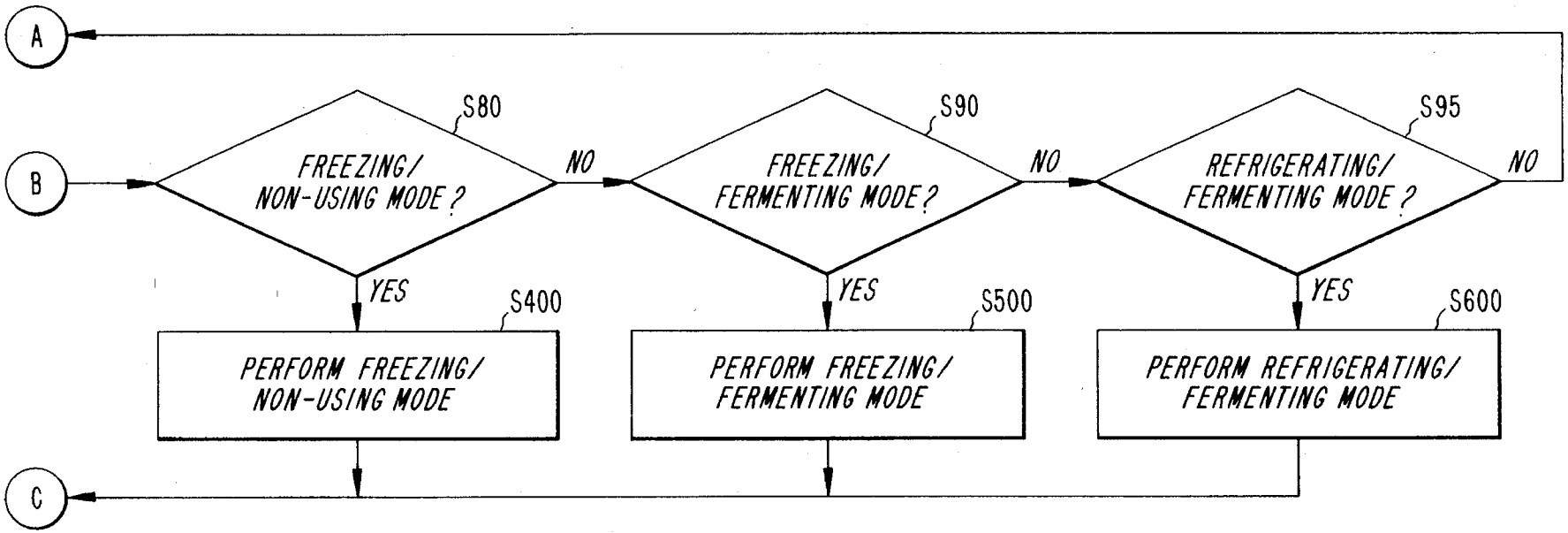

Referring to FIG. 3, an operation mode set, that is, the functions for the first and second compartments 1 and 2, are input into the system controller 20 in step S10. The user may select one operation mode from a total of six operation modes, which are comprised of freezing/refrigerating, refrigerating/refrigerating, refrigerating/non-using, freezing/non-using, freezing/fermenting, and refrigerating/fermenting.

Passing through steps S50 to S90 and S95, the system controller 20 identifies what the selected operation mode. Passing through the steps S100 to S600, the first and second compartments 1 and 2 are controlled to function in accordance with the selected operation mode.

Figure 4:
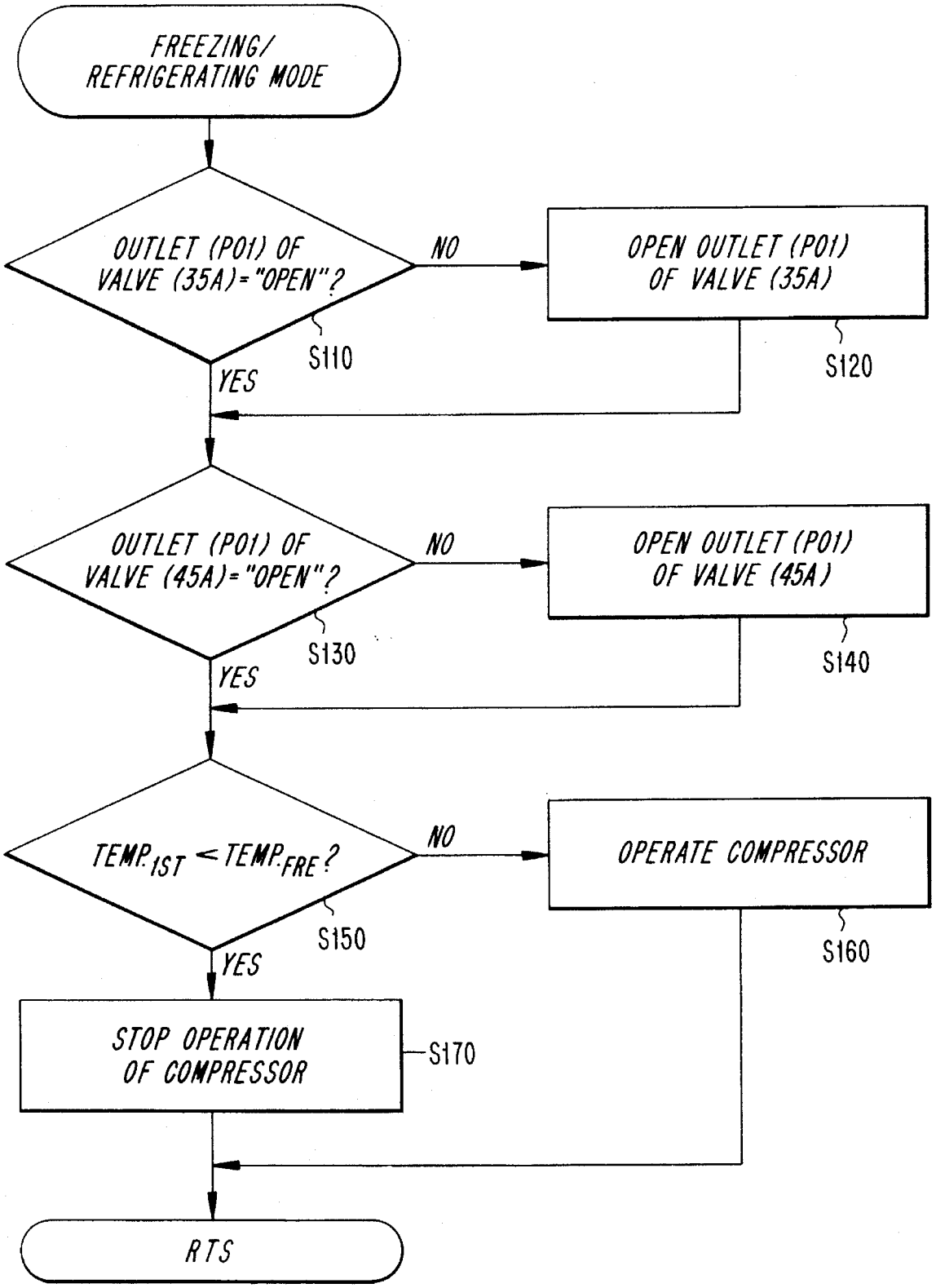

FIG. 4 is a flow chart explaining the control method wherein the user selects the first compartment 1 as a freezing compartment, and the second compartment 2 as a refrigerating compartment.

Referring to FIG. 4, the system controller 20 determines whether or not the first outlet PO1 of the first three-way valve 35A is opened in step S110. When the first outlet PO1 of the first three-way valve 35A is closed in step S110, the program advances to step S120, and then the first outlet PO1 of the first three-way valve 35A is opened. In step S130, it is determined whether or not the first outlet PO1 of the second three-way valve 45A is opened. When the first outlet PO1 of the first three-way valve 45A is closed in step S130, the program advances to step S140, and then the first outlet PO1 of the second three-way valve 45A is opened. In step S150, it is determined whether or not the temperature of the first compartment 1 is lower than the desired freezing temperature. When the temperature of the first compartment 1 is lower than the freezing temperature in step S150, the program advances to step S170, and then the operation of the compressor 70 is stopped. Conversely, when the temperature of the first compartment 1 is higher than the freezing temperature in step S150, the program advances to step S160, and then the compressor 70 is operated continuously.

In FIG. 4, when the outlet PO1 of the first three-way valve 35A is opened, the refrigerant which passes through the first section 52 of the first evaporator 50 then flows into the second section 54 of the first evaporator 50, thereby relatively increasing the refrigerating rate per unit time. Consequently, the first compartment 1 functions as a freezing compartment. Furthermore, when the outlet PO1 of the second three-way valve 45A is opened, the refrigerant which passes through the first evaporator 50 then flows into the second evaporator 60. Consequently, the second compartment 2 functions as a refrigerating compartment.

The second evaporator 60 may be constructed in a manner whereby the second compartment 2 is maintained at a desired refrigerating temperature, for example 4° C., when the temperature of the first compartment 1 is maintained at the freezing temperature.

Figure 5:
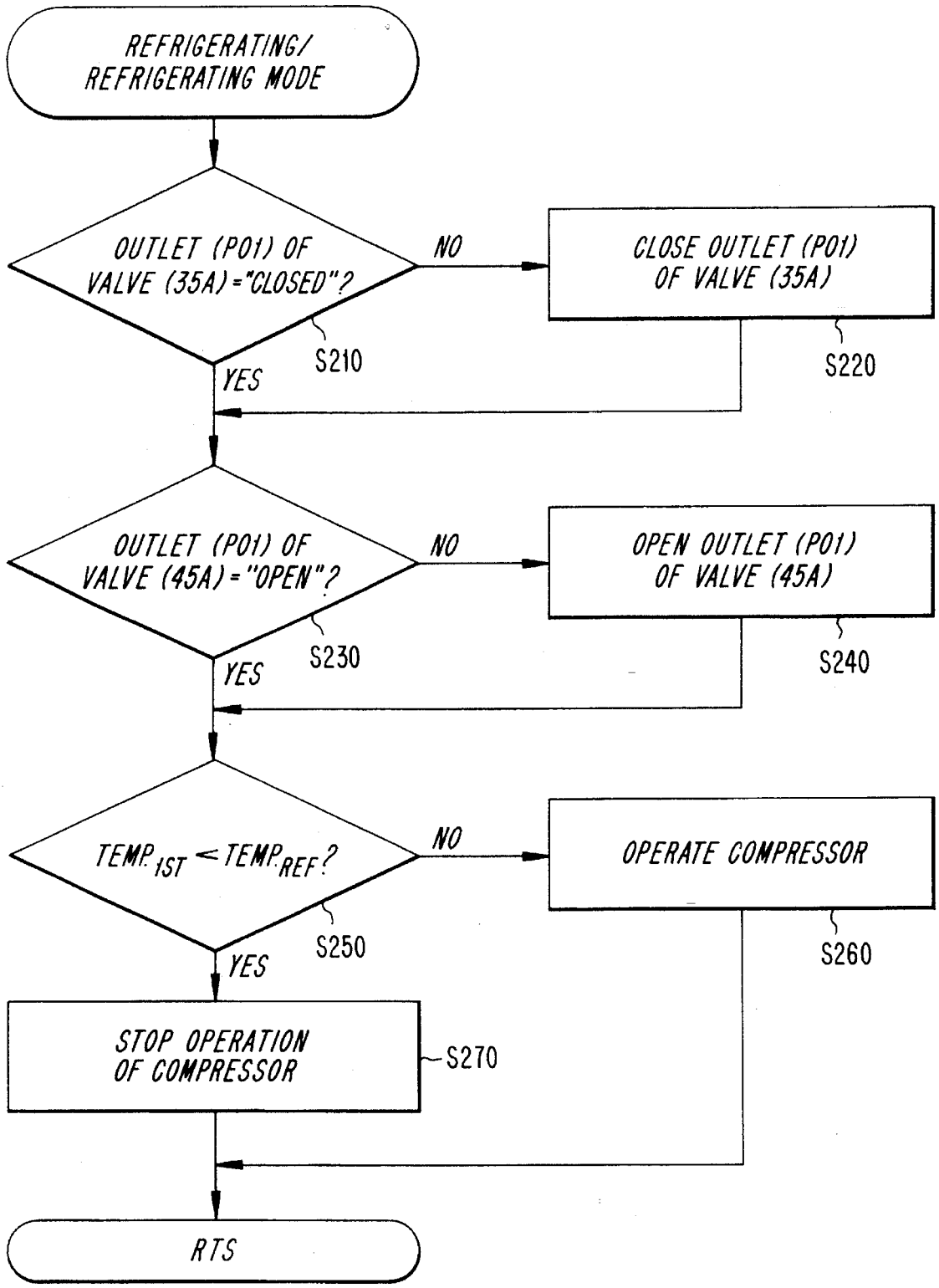

FIG. 5 is a flow chart explaining the control method wherein the user selects both the first and second compartments I and 2 to be refrigerating compartments.

Referring to FIG. 5, the system controller 20 determines whether or not the first outlet PO1 of the first three-way valve 35A is closed in step S210. When the first outlet PO1 of the first three-way valve 35A is opened in step S210, the program advances to step S220, and then the first outlet PO1 of the first three-way valve 35A is closed. In step S230, the system controller 20 determines whether or not the first outlet PO1 of the second three-way valve 45A is opened. The following steps S240 through S270 in FIG. 5 are the same as the steps S140 through S170 in FIG. 4, except that the temperature of the first compartment 1 is compared to the desired refrigerating temperature in step S250.

In FIG. 5, when the first outlet PO1 of the first three-way valve 35A is closed, the refrigerant which passes through the first section 52 of the first evaporator 50 directly flows into the second evaporator 60, bypassing the second section 54 of the first evaporator 50, thereby relatively lowering the refrigerating rate per unit time. Consequently, the first compartment 1 functions as a refrigerating compartment. Furthermore, the operation of the compressor 70 may be controlled according to either the temperature of the second compartment 2 or the temperature of the first compartment 1.

Figure 6:
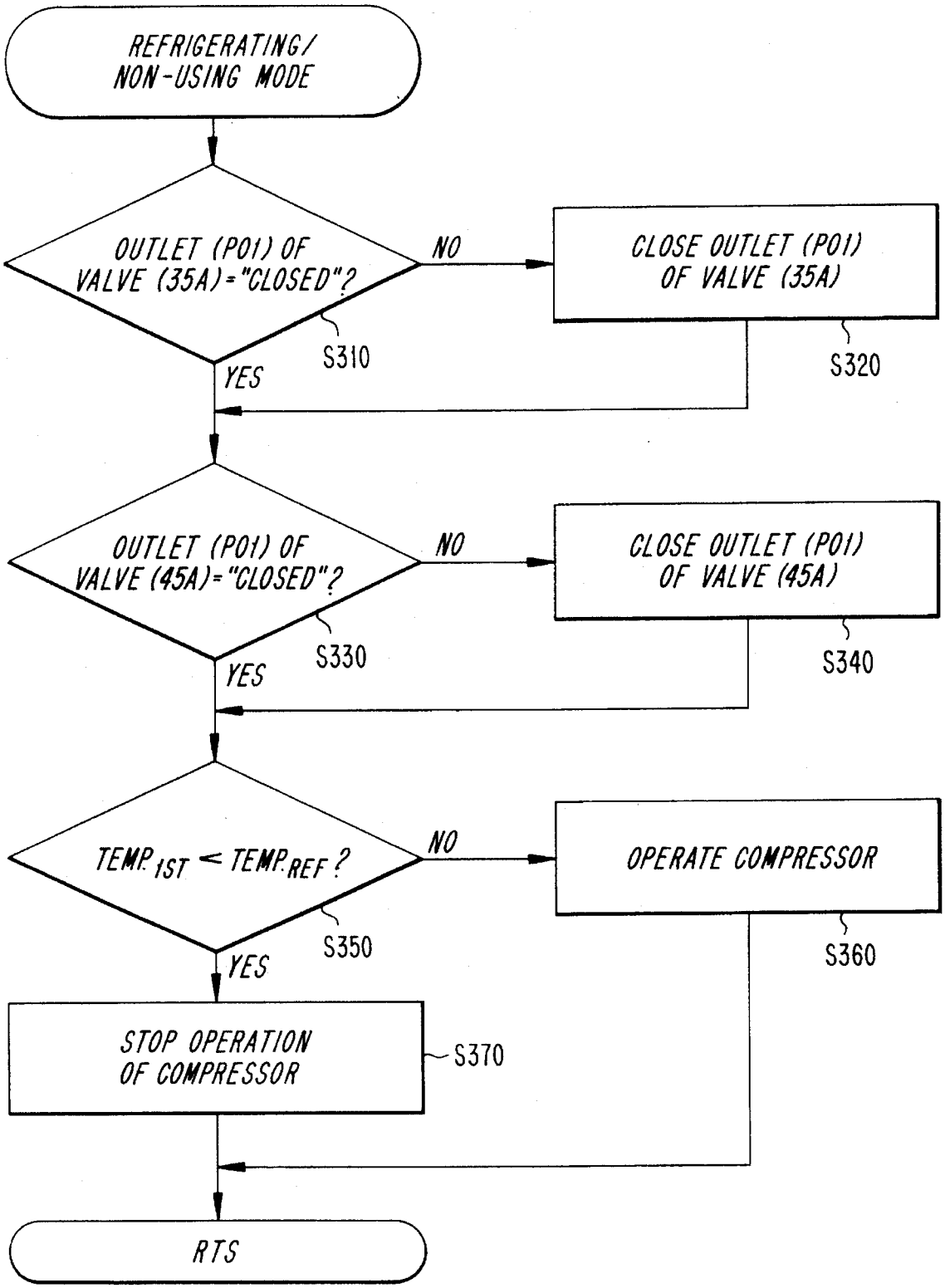

FIG. 6 is a flow chart explaining the control method wherein the user selects only the first compartment 1 as a refrigerating compartment, and does not use the second compartment 2.

Referring to FIG. 6, the first outlets PO1 of the first and second three-way valves 35A and 45A are controlled to be closed. Furthermore, the operation of the compressor 70 is controlled according to the temperature of the first compartment 1.

Figure 7:
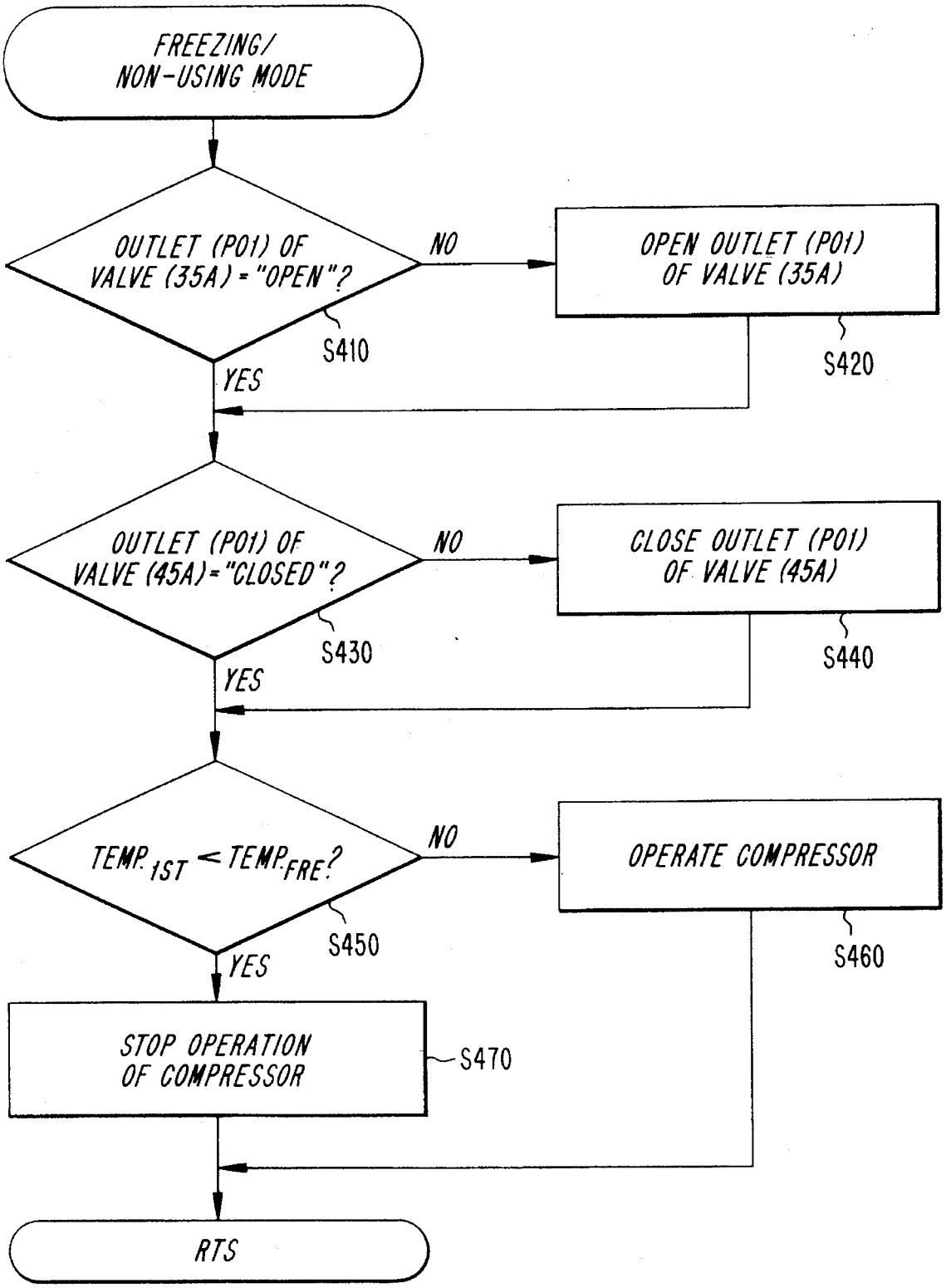

FIG. 7 is a flow chart explaining the control method wherein the user selects only the first compartment 1 as a freezing compartment, and does not use the second compartment 2.

Referring to FIG. 7, the first outlet PO1 of the first three-way valve 35A is controlled to be opened, and the outlet PO1 of the second three-way valve 45A is controlled to be closed. Furthermore, the operation of the compressor 70 is controlled according to the temperature of the first compartment 1.

Figure 8A:
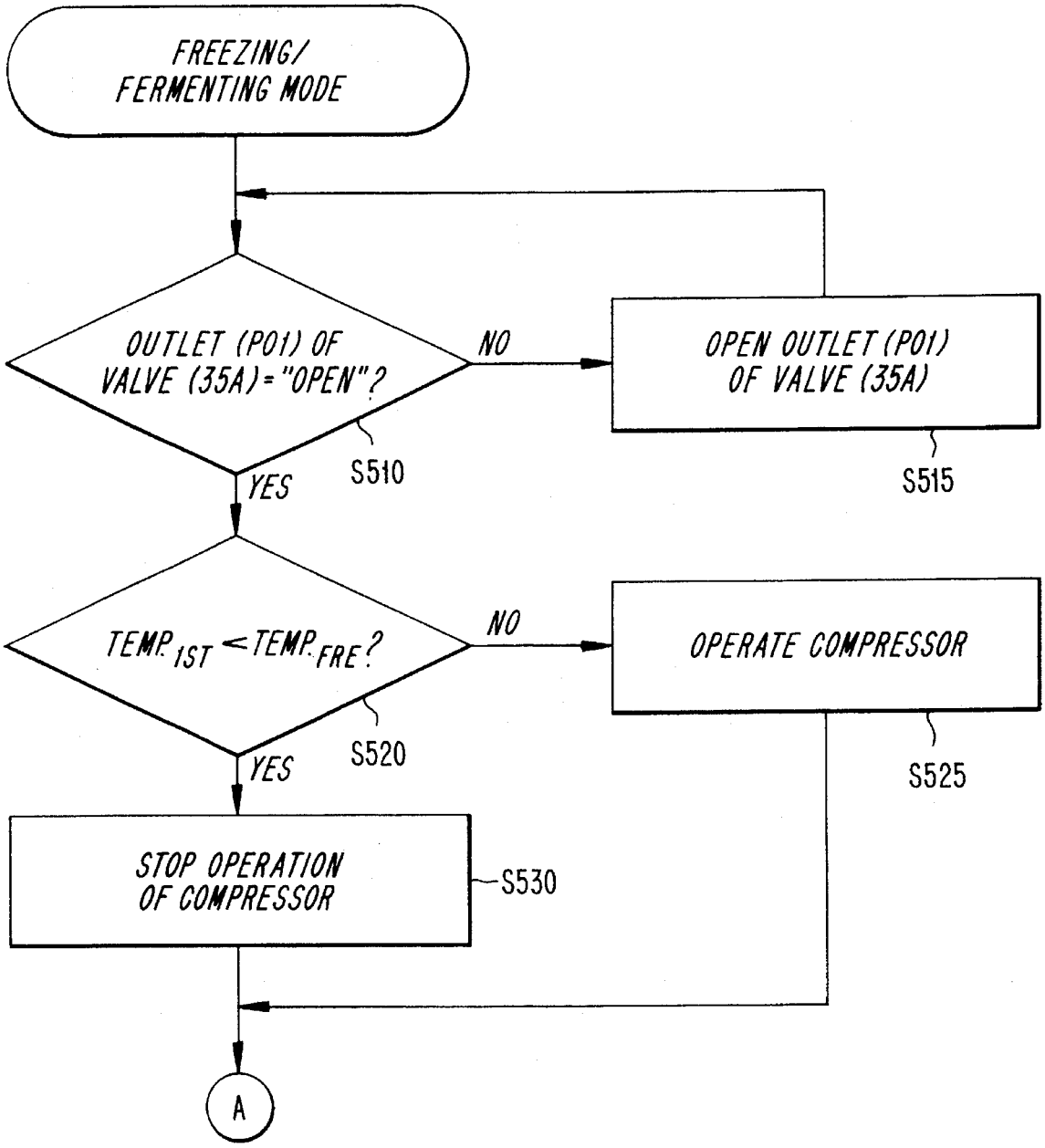
Figure 8B:
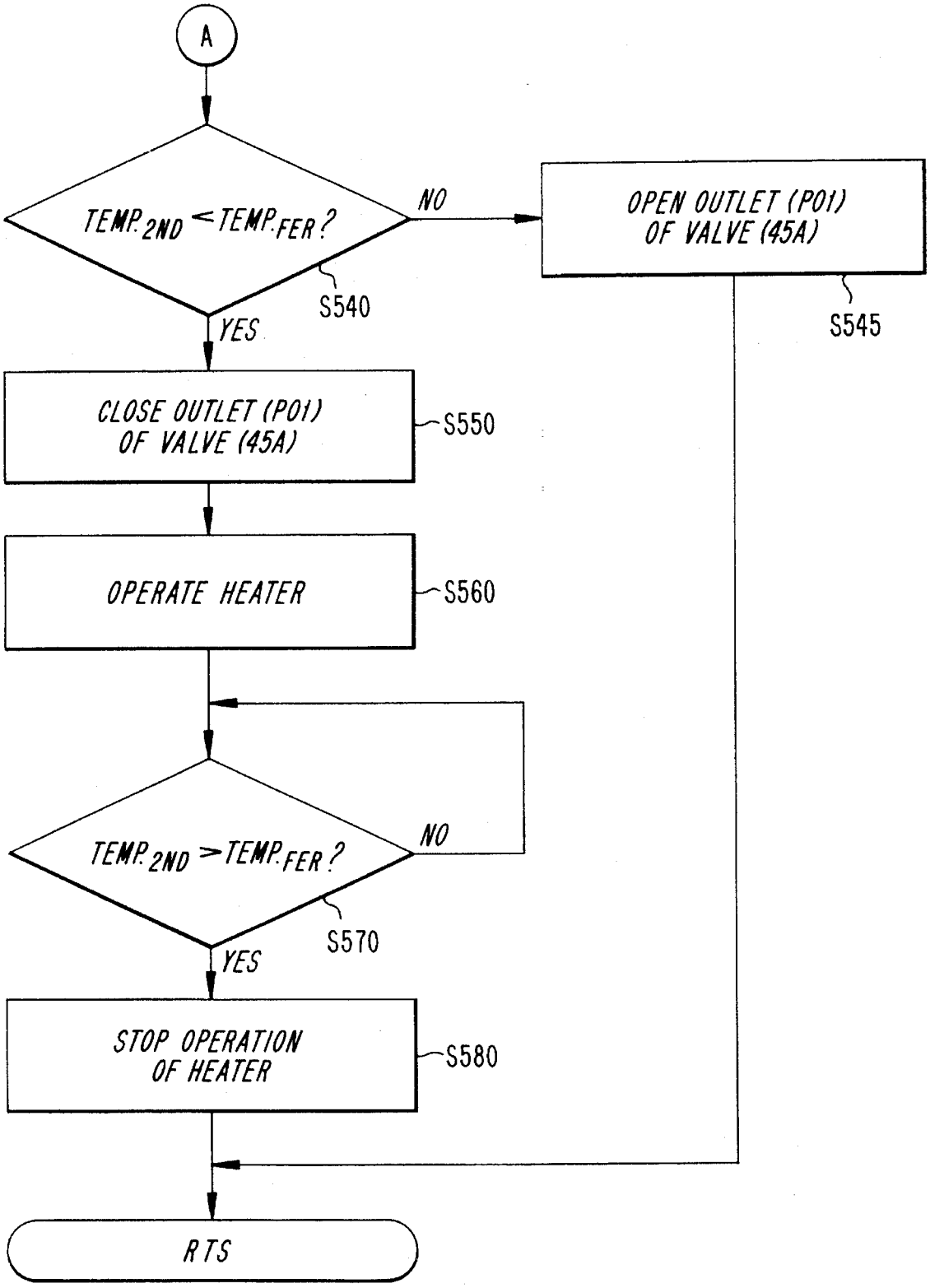

FIG. 8 is a flow chart explaining the control method wherein the user selects the first compartment 1 as a freezing compartment, and the second compartment 2 as a fermenting compartment.

Referring to FIG. 8, the system controller 20 determines whether or not the first outlet PO1 of the first three-way valve 35A is opened in step S510. When the first outlet PO1 of the first three-way valve 35A is closed in step S510, the program advances to step S515, and then the first outlet PO1 of the first three-way valve 35A is opened. In step S520, it is determined whether or not the temperature of the first compartment 1 is lower than the desired freezing temperature. When the temperature of the first compartment 1 is lower than the freezing temperature in step S520, the program advances to step S530, and then the operation of the compressor 70 is stopped. Conversely, when the temperature of the first compartment 1 is higher than the freezing temperature in step S520, the program advances to step S525, and then the compressor 70 is continuously operated. In step S540, it is determined whether or not the temperature of the second compartment 2 is lower than the desired fermenting temperature. When the temperature of the second compartment 2 is lower than the fermenting temperature in step S540, the program advances to step S550, and the outlet PO1 of the second three-way valve 45A is controlled to be closed. In step S560, the heater 100 is operated to increase the temperature of the second compartment 2. In step S570, when the temperature of the second compartment 2 becomes higher than the fermenting temperature, the program advances to step S580, and then the operation of the heater 100 is stopped. When the temperature of the second compartment 2 is higher than the fermenting temperature in step S540, the outlet PO1 of the second three-way valve 45A is controlled to be opened in step S545.

In FIG. 8, when the first compartment 1 functions as a freezing compartment and the second compartment 2 functions as a fermenting compartment, the operation of the compressor 70 is controlled according to the temperature of the first compartment 1.

Accordingly, the temperature of the second compartment 2 may be maintained above or below the fermenting temperature for example 25° C., with deviations. However, it is possible to obtain a uniform fermentation condition by properly controlling the fermenting time in relation to changes in the fermenting temperature.

Figure 9A:
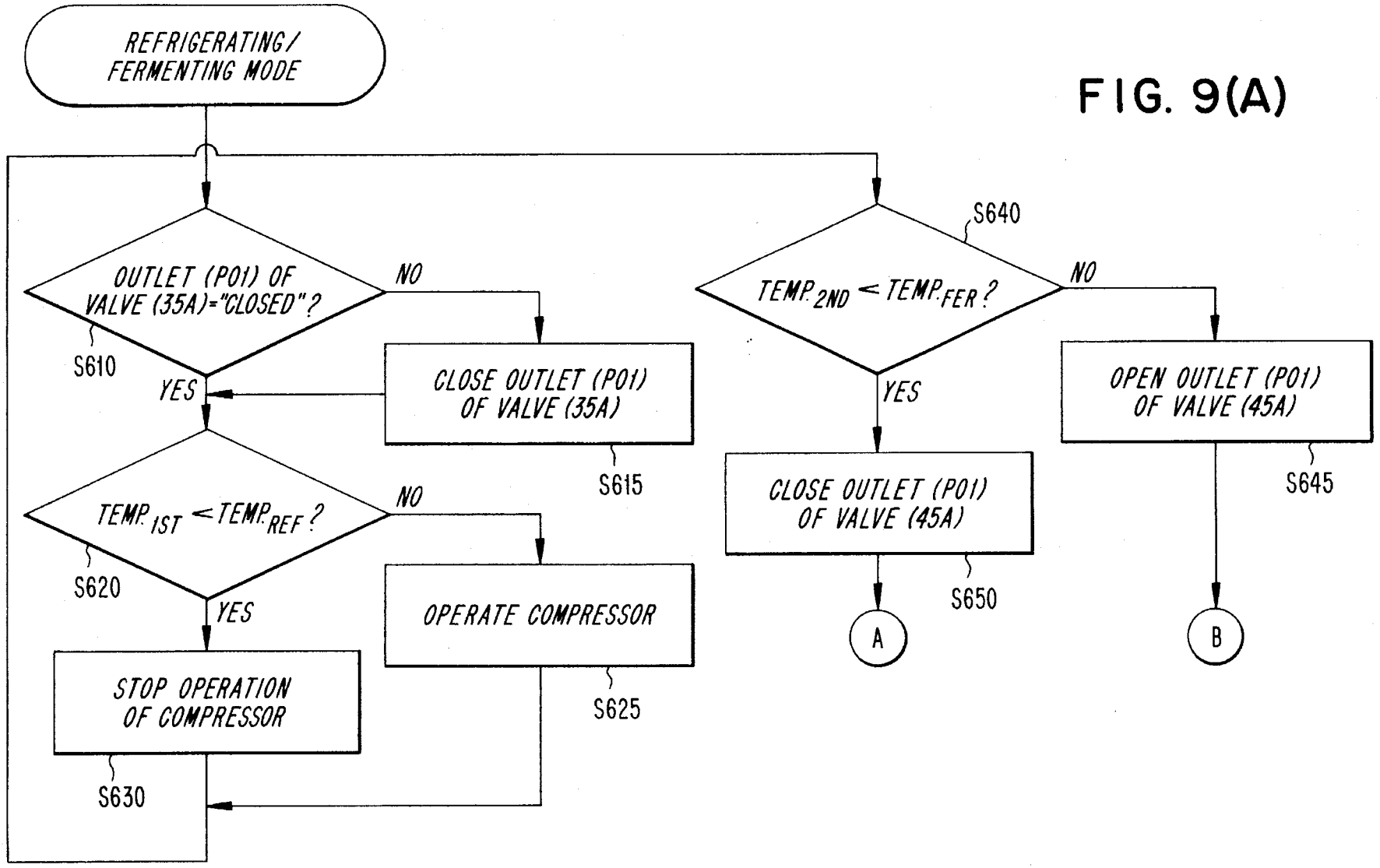
Figure 9B:
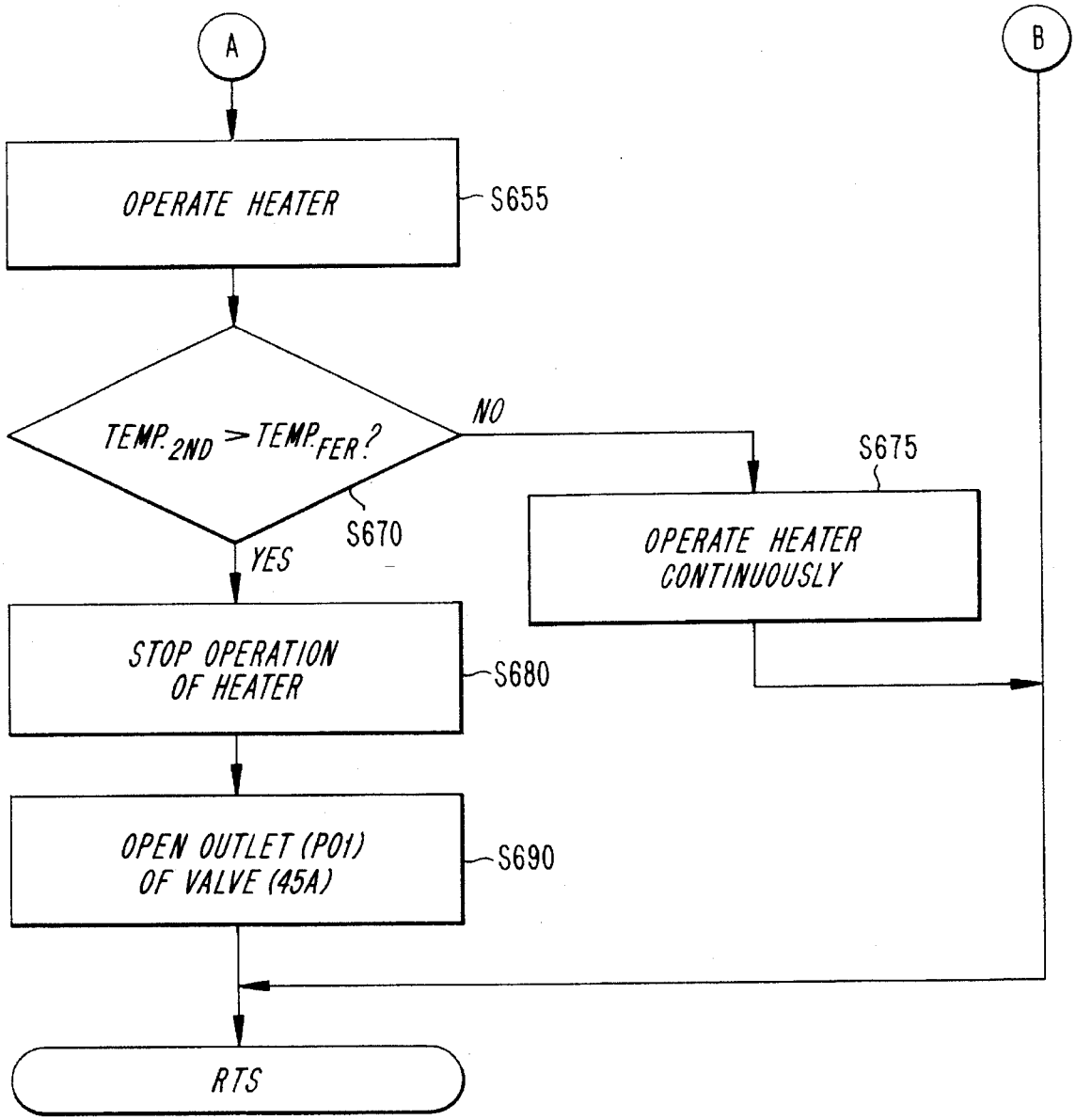

FIG. 9 is a flow chart explaining the control method wherein user selects the first compartment i as a refrigerating compartment, and the second compartment 2 as a fermenting compartment.

Referring to FIG. 9, the system controller 20 determines whether or not the first outlet PO1 of the first three-way valve 35A is closed in step S610. When the first outlet PO1 of the first three-way valve 35A is opened in step S610, the program advances to step S615, and then the first outlet PO1 of the first three-way valve 35A is closed. In step S620, the system controller 20 determines whether or not the temperature of the first compartment 1 is lower than the desired refrigerating temperature. When the temperature of the first compartment 1 is lower than the refrigerating temperature in step S620, the program advances to step S630, and then the operation of the compressor 70 is stopped. Conversely, when the temperature of the first compartment 1 is higher than the refrigerating temperature in step S620, the program advances to step S625, and then the compressor 70 is continuously operated. In step S640, the system controller 20 determines whether or not the temperature of the second compartment 2 is lower than the desired fermenting temperature. When the temperature of the second compartment 2 is lower than the fermenting temperature in step S640, the program advances to step S650, and the outlet PO1 of the second three-way valve 45A is controlled to be closed. In step S655, the heater 100 is operated to increase the temperature of the second compartment 2. In step S670, the system controller 20 determines whether or not the temperature of the second compartment 2 becomes higher than the fermenting temperature. When the temperature of the second compartment 2 is higher than the fermenting temperature in step S670, the program advances to step S680, and then the operation of the heater 100 is stopped. In step S690, the outlet PO1 of the second three-way valve 45A is controlled to be opened. When the temperature of the second compartment 2 is higher than the fermenting temperature in step S640, the outlet PO1 of the second three-way valve 45A is controlled to be opened. When the temperature of the second compartment 2 is lower than the desired temperature in step S670, the heater 100 is continuously operated in step S675, and then the program is repeated.

In FIG. 9, the operation of the compressor 70 is controlled according to the temperature of the first compartment 1. Accordingly, the temperature of the second compartment 2 may be maintained above or below the fermenting temperature, for example 25° C., with deviations However, it is possible to obtain a uniform fermentation condition by properly controlling the fermenting time in relation to changes in the fermenting temperature.

Furthermore, the refrigerator may further comprise an operation mode in that the second compartment 2 initially performs the fermenting function and then automatically converts the function into the refrigerating function upon completing the fermenting function.

We claim:

1. A refrigerator, comprising:

first and second food storage compartments for receiving cooled air;

a first heat exchanger for cooling the air of said first compartment by conducting cooled refrigerant into heat exchange relationship therewith, said first heat exchanger including an upstream heat exchanger section and a downstream heat exchanger section;

a second heat exchanger for cooling the air of said second compartment by conducting cooled refrigerant into heat exchange relationship therewith;

a first valve including:

an inlet connected to an outlet of said upstream heat exchanger section, a first outlet connected to an inlet of said downstream heat exchanger section, and a second outlet connected to an inlet of said second valve;

a second valve including:

a first outlet connected to said second heat exchanger, and a second outlet bypassing said second heat exchanger;

said first and second valves being independently actuable to selectively close either of said first and second outlets thereof and thereby change the amount of cooling performed by the first and second heat exchangers independently of one another.

2. A refrigerator according to claim 1, wherein said second compartment includes a heater for increasing the temperature thereof when said first outlet of said second valve is closed.

3. A refrigerator according to claim 1 including a temperature sensor for sensing the temperature in said first compartment and being connected to a compressor of said cooling system for controlling operation of said compressor when said first outlet of said first valve is open.

* * * * *